US005240806A

United States Patent [19]

Tang et al.

[11] Patent Number: 5,240,806

[45] Date of Patent: Aug. 31, 1993

[54] LIQUID COLORED TONER COMPOSITIONS AND THEIR USE IN CONTACT AND GAP ELECTROSTATIC TRANSFER PROCESSES

[75] Inventors: Kuo-Chang Tang, Bethany; Peter E. Materazzi, Southington, both of Conn.

[73] Assignee: Olin Corporation, Cheshire, Conn.

[21] Appl. No.: 816,904

[22] Filed: Jan. 3, 1992

Related U.S. Application Data

[63] Continuation-in-part of Ser. No. 765,625, Sep. 25, 1991, which is a continuation-in-part of Ser. No. 657,012, Feb. 15, 1991, Pat. No. 5,116,705, which is a continuation-in-part of Ser. No. 498,785, Mar. 26, 1990, abandoned.

[51] Int. Cl.[5] ..... G03G 9/00

[52] U.S. Cl. ..... 430/115; 430/45; 430/47; 430/114

[58] Field of Search ..... 430/45, 47, 114, 115

[56] References Cited

U.S. PATENT DOCUMENTS

| | | | |
|---|---|---|---|
| 3,668,127 | 6/1972 | Machida et al. . | |
| 3,900,412 | 8/1975 | Kosel | 252/62.1 |
| 3,993,483 | 11/1976 | Maki et al. | 96/1 LY |
| 4,360,580 | 11/1982 | Tsubuko et al. | 430/137 |
| 4,378,422 | 3/1983 | Landa et al. | 430/137 |
| 4,507,377 | 3/1985 | Alexandrovich . | |
| 4,575,478 | 3/1986 | Ohno . | |
| 4,732,831 | 3/1988 | Riesenfeld et al. | 430/60 |
| 4,734,352 | 3/1988 | Mitchell . | |
| 4,760,009 | 7/1988 | Larson . | |
| 4,786,572 | 11/1988 | Haku et al. | 430/60 |
| 4,786,576 | 11/1988 | Bujese et al. | 430/126 |
| 4,789,616 | 12/1988 | Croucher et al. | 430/109 |
| 4,794,651 | 12/1988 | Landa et al. | 430/109 |
| 4,798,778 | 1/1989 | El-Sayed et al. | 430/115 |
| 4,812,377 | 3/1989 | Wilson et al. | 430/109 |
| 4,855,207 | 8/1989 | Tsubuko et al. . | |
| 4,899,521 | 2/1990 | Havens | 428/423.3 |
| 4,925,766 | 5/1990 | Elmasry et al. . | |
| 4,946,753 | 8/1990 | Elmasry et al. | 430/45 |
| 4,971,883 | 11/1990 | Chan et al. | 430/114 |
| 4,978,598 | 12/1990 | Elmasry et al. . | |
| 4,988,602 | 1/1991 | Jongewaard et al. . | |

FOREIGN PATENT DOCUMENTS

| | | |
|---|---|---|
| 5032624 | 10/1975 | Japan . |
| 6076755 | 10/1983 | Japan . |
| 6076775 | 5/1985 | Japan . |
| 5428629 | 12/1987 | Japan . |

*Primary Examiner*—Marion E. McCamish
*Assistant Examiner*—S. Rosasco
*Attorney, Agent, or Firm*—William A. Simons

[57] ABSTRACT

A liquid colored electrostatic toner comprising:

(A) a colored predispersion comprising (1) a non-polymeric resin material having certain insolubility (and nonswellability), melting point, and acid number characteristics; (2) an alkoxylated alcohol having certain insolubility (and nonswellability) and melting point characteristics; and (3) colorant material having certain particle size characteristics; and (B) an aliphatic hydrocarbon liquid carrier having certain conductivity, dielectric constant, and flash point.

14 Claims, No Drawings

LIQUID COLORED TONER COMPOSITIONS AND THEIR USE IN CONTACT AND GAP ELECTROSTATIC TRANSFER PROCESSES

CROSS-REFERENCES TO RELATED APPLICATIONS

This patent application is a continuation-in-part application of U.S. patent application Ser. No. 07/765,625, filed on Sep. 25, 1991 with Peter E. Materazzi as the named inventor, which is a continuation-in-part application of U.S. patent application Ser. No. 07/657,012, filed on Feb. 15, 1991 with Peter E. Materazzi as the named inventor, that issued as U.S. Pat. No. 5,116,705 on May 26, 1992 which is a continuation-in-part application of U.S. patent application Ser. No. 07/498,785, filed on Mar. 26, 1990 with Peter E. Materazzi as the named inventor, now abandoned. All three of these applications are incorporated herein by reference in their entireties.

BACKGROUND OF THE INVENTION 1. Field of the Invention

The present invention relates to a liquid colored toner composition suitable for use in contact and gap electrostatic transfer processes. The present invention further relates to a liquid colored toner composition which comprises a mixture of a carrier liquid and a colored predispersion which is made by mixing together at least one selected nonpolymeric resin material, at least one selected alkoxylated alcohol, and at least one selected colorant material. 2. Brief Description of the Prior Art Liquid toner compositions for use in developing latent electrostatic images are well-known in the art. Additionally, liquid toner compositions suitable for use in contact electrostatic transfer processes, as well as liquid toner compositions suitable for use in gap electrostatic transfer processes, are documented in the patent literature. In the contact electrostatic transfer process, a toned image is formed on a suitable photoreceptor after which the toned image is brought into contact with a receiver substrate such as paper. An electrostatic potential opposite in polarity of the toner is applied to the receiver substrate (usually by use of a corona) which causes transfer of the toner from the photoreceptor to the receiver substrate. Some commercial examples of this process are the Ricoh and Savin plain paper liquid copiers.

The gap electrostatic transfer process is generally similar to contact transfer except the receiver substrate does not contact the photoreceptor. Instead, it is physically separated by an 0.5 to approximately 10 mil gap. This gap can be filled with carrier liquid or air. Two different approaches to this process are described by Landa (U.S. Pat. No. 4,378,422) and by Bujese (U.S. Pat. No. 4,786,576). The liquid toner requirements for contact and gap electrostatic transfer are quite similar.

Most of the early liquid toner patent literature relates to toners intended for use in relatively low quality black and white copiers. While many of these disclosures are suitable for their intended purposes, most are clearly unacceptable for use in high quality color imaging.

Many recent patents have issued which describe liquid toners intended for high quality color imaging. Many of these toners can be used in contact and gap electrostatic transfer processes. While most of these later toners are superior to those in the early black and white toners, many problems still remain. Specifically, concerning liquid toners intended for contact or gap electrostatic transfer multicolor imaging processes, there remains a need for toners which possess all of the following properties:

(a) Charge Properties Which are Independent and Unaffected by Pigment Choice Adverse charging effects from pigments is, perhaps, the greatest source of trouble for the liquid toner formulator. Pigments are usually heterogeneous materials containing substantial amounts of impurities in addition to post-added dispersants and flow agents. Different pigments vary considerably in their composition of these compounds, and even batch-to-batch variations can be quite significant. Reducing, or eliminating, the charging effects due to these compounds is a major first step in designing charge stable toners. It is important to use charge stable toners for multicolor imaging in order to achieve and maintain color balanced imaging. There are a number of recent liquid toner patents which attempt to address the problem of charge stability. Most relate to specific charge directors, and/or specific charge adjuvants, and generally avoid the issue of solving the pigment problem. Charge independence from pigments gives an added benefit of allowing different color toners to be formulated having the same charge and imaging properties. These toners can be blended to a desired shade and used in a color-matching system, such as the PANTONE color-matching process which is popular in the printing ink industry. Different color toners, which have similar charging and imaging properties, will hereafter be called "color blind" toners. It has been found that certain toners containing particles which are not swellable in the liquid carrier may be made color blind.

High Transparency

This property is generally achieved by mechanically reducing pigment agglomerates down as close as possible to the primary pigment particle size, around 0.05 to 0.5 microns, and dispersing the particles as homogeneously as possible. A means must be present to keep the pigment particles from re-agglomerating. This is usually achieved by dispersing the pigment particles in a rigid or semirigid resin binder, although steric stabilization in solution can also be used. It has been found that it is extremely difficult to disperse substantial amounts of pigments (i.e, $\geqq 10$ wt. %) down to their primary particle sizes in most of the common polymeric binders used in previous liquid toners. Examples of these types of binders include polystyrenes, polymethylmethacrylates, polyesters, and polyvinyl acetates. In addition, virtually all crystalline waxes and crystalline homopolyethylene resins, which are very popular in the black and white toner art, are not transparent and, thus, cannot be used in substantial amounts in color toners. Also, mixing two transparent resins together which are not soluble in each other will usually result in a hazy, nontransparent composite The above limitations further limit the choice of suitable resin binders for high quality color toners.

(c) Ability to Replenish Developer Bath Using High Solids Concentrate

This issue is rarely addressed, if ever, in the liquid toner patent literature. However, it is very important when considering medium to high speed multicolor printing.

For example, take the case of when more than a hundred 8.5×11 inch four-color prints per minute are being made. The page coverage can range from 0 to 400% with 100 to 200% coverage being common. A substantial amount of toner may be consumed. To illustrate the problem, consider printing an 8½×11 inch image at 80% coverage, wherein the weight of toner solids applied per page was 0.167 grams and the printing rate was 200 pages per minute. Then the amount of toner concentrate and ISOPAR carrier liquid used per hour would be as shown in Table below:

| | Toner Usage | |
|---|---|---|
| % of Solids in Liquid Toner | Gallons of Toner Conc. Per Hour | Gallons of ISOPAR Solvent Per Hour |
| 10 | 7.14 | 6.43 |
| 20 | 3.57 | 2.86 |
| 30 | 2.38 | 1.67 |
| 40 | 1.79 | 1.07 |

Clearly, the data in this table shows that a high solids concentrate replenishment is very beneficial because less gallons of toner concentrate and less gallons of ISOPAR liquid carrier will be used. Most of the liquid toners suitable for contact, or gap, electrostatic transfer, described in the literature, are made with carrier liquid swelled particles which tend to gel heavily around 20% solids. Most of these toners are not acceptable for use in a high solids replenishment system. It has been found that liquid toners, of the present invention, which contain hard and nontacky particles that are not swelled by the carrier liquid in the 0.5 to 10 micron particle size range can be made free flowing even at a high solids content. These toners of the present invention are acceptable for use in contact, or gap, electrostatic transfer processes.

(d) Ability to Produce High Resolution Images

High quality, multicolor half-tone imaging generally requires the ability to image greater than 5 to 95% half-tone dots using a 150 line screen ruling along with at least a 10 micron limiting resulting resolution. Toner image spread also needs to be reduced or eliminated to avoid excess dot gain. Many recent liquid toner patents describe various additives and preferred embodiments designed to achieve these desired results. The toners disclosed in this invention achieve the above criteria by using hard, compression-resistant resin particles in a particular particle size range.

(e) Good Transfer Properties

The toners of the present invention have transfer properties suitable for use with both contact and gap electrostatic transfer processes.

3. Discussion of Possible Relevant References

Machida et al. (JP-50-32624) describes a liquid developer for electrostatic photography transfer which contains a liquid carrier; pigments or dyes; resins which are insoluble in liquid carrier and are either nonswellable or swellable in the liquid carrier; plasticizers which are insoluble in carrier liquid and have a high dielectric constant and low electrical resistance. ISOPAR G or H are among the liquid carriers disclosed. Carbon black and other pigments and dyes are disclosed. The disclosed class of nonswellable resins include Pentalyn H which is a maleic-modified rosin. Disclosed plasticizers include dimethyl phthalate, n-butanol, methylethyl ketone, ethylene glycol and polyester plasticizers, among others. All of the plasticizers disclosed in this Japanese Kokai fluid or are liquid at room temperature (20°-30° C.). The reference teaches alternate methods for making their liquid developers. One method disclosed is to knead the pigment or dye, the resin or resins and the plasticizer together in roll mill. This mixture is combined with liquid carrier to form microgranules in a ball mill or jet mill. The resultant microgranules are dispersed in more liquid carrier. The resultant dispersion is ground to the desired particle size in a ball mill or colloid mill or the like in order to make concentrated liquid developer, The concentrate is diluted with more carrier liquid to obtain desired solids content for machine use. More plasticizer may be added during the dilution step. One disadvantage is that the liquid or flowable plasticizer can render the toner particles tacky and will not flow easily in high solids concentration.

Maki et al. (U.S. Pat. No. 3,993,483) describes liquid electrostatic transfer toners which contain at least one compound of Group (A) and a least one compound of Group (B). Group (A) compounds include rosin modified phenol resin, rosin modified maleic acid resin, and rosin modified pentaerythritol. Group (B) compounds include low molecular polyethylene, ethylene ethylacrylate copolymers, ethylene vinylacetate copolymer, and low molecular polypropylene. The ratio of compound A to B varies from 100:60 to 100:400. The toners are prepared simply by ball milling the above together with a colorant and an aromatic carrier liquid (e.g., Solvesso 100), usually at an elevated temperature. These toners of Maki et al. are not acceptable for high quality printing for the following reasons:

First, the pigments are directly exposed to the carrier liquid which eliminates the color blind property. Second, the binders, particularly the (B) components, are substantially swelled with the carrier liquid and will gel at a high solids content. High solids replenishment is not possible.

Machida et al. (U.S. Pat. No. 3,668,127) describes liquid toners characterized as having pigment particles coated with a resinous layer consisting of at least two layers of which the first or inner resin layer is directly coated on the pigment particles and is comprised of a resin which is insoluble in the carrier liquid while the outermost layer comprises a resin capable of somewhat swelling in the carrier liquid. Resins disclosed for the first layer include styrene-butylmethacrylate (7:3), styrene-lauryl methacrylate (9:1), methylmethacrylate-butylmethacrylate, among others. Resins suitable for the swelled layer include styrene-lauryl methacrylate (1:1) and styrene-butylmethacrylate-acrylic acid (3:7:1), among others. The use of modified natural rosins as such binder resins and the use of plasticizers are not taught. The patentees claim that encapsulating the pigments in this manner gives improved charge stability, gives uniform charge, and reduces background staining. This might appear to be a good way to make a color blind liquid toner. However, as the toner particles settled, they would form a solid mass. As such, the disclosed toners are not suitable for high solids replenishment.

Tsubuko et al. (U.S. Pat. No. 4,360,580) describes liquid developers suitable for contact electrostatic transfer which are prepared by blending in the carrier liquid:

(1) a resin dispersion A comprising a polymer obtained from at least one kind of resin which is difficult to dissolve, or insoluble, in the carrier liquid and at least one kind of monomer which is soluble in said resin; and (2) a pigment coated with resin B which is different than resin dispersion composition A and is substantially insoluble in the carrier liquid.

Dispersion A is made by polymerizing, for example, lauryl methacrylate in the presence of a natural rosin or modified natural rosin. It acts as a dispersant for the colored B composition. Resins cited for component B include natural rosins and modified natural rosins. Pigments are kneaded into the B resin before dispersing with component A. Optionally, a charge controlling monomer, such as acrylic acid, may be polymerized in the presence of resin B and the pigments during the kneading process. The patentees claim improved polarity controlling ability, improved storage stability, and improved transfer property. The incorporation of plasticizers is not taught. Also, the term "substantially insoluble" is not defined. Many of the cited resins for use in component B are known to swell and/or dissolve somewhat in the carrier liquid. In addition, many of the resins cited for component B have softening points above 100° C. In this case, poor image fusing would be expected unless the particles were swelled and plasticized by the carrier liquid. These disclosed toners have not demonstrated the color blind property and probably cannot be used in a high solids replenishment system.

Several other liquid electrostatic toner patents have issued which describe coating the pigments with so-called carrier nonsoluble natural rosins or modified natural rosins. None of these approaches have been successful in achieving all the criteria needed for high quality color imaging using the contact, or gap, electrostatic transfer processes. Not surprisingly, most recent color liquid toner work has concentrated on using man-made polymeric binders, particularly polyesters and polyethylenes.

Alexandrovich (U.S. Pat. No. 4,507,377) describes liquid toners comprised of a compatible blend of at least one polyester resin and at least one polyester plasticizer. The resin and plasticizer are dissolved in an aromatic solvent and ball milled together with pigments and a dispersant to produce a concentrated dispersion. The concentrate is next diluted in the carrier liquid where the resin and plasticizer precipitate out of solution and coat the pigments. This patent teaches the importance of selecting compatible binder components in order to achieve high transparency. Compatible means that the components are soluble in each other and remain clear and transparent when mixed together. This patent also teaches the importance of using a plasticizer which is not soluble in the carrier liquid. One big disadvantage in this disclosure is the use of an aromatic solvent in making the concentrated dispersion. The pigments are exposed to this aromatic solvent during the dispersion step which adversely affects the color blind property.

Wilson et al. (U.S. Pat. No. 4,812,377) describes specific polyester resins which are suitable for liquid or dry toners. In this patent, the pigments are kneaded into the resin prior to ball milling in the carrier liquid. The patentees mention that these particular resins are brittle and can be easily ground to small particle sizes. Additionally, the patentees claim good pigment dispersing ability with these resins.

Landa et al. (U.S. Pat. No. 4,794,651) and Larson (U.S. Pat. No. 4,760,009) describe polyethylene-based liquid toners which are prepared, for example, by:

(1) heating the polyethylene resin and pigment in the carrier liquid to plasticize and dissolve the resin;
(2) ball milling the mixture, at an elevated temperature, to finely disperse the pigments; and
(3) cooling the mixture, with or without grinding, to precipitate the resin onto the pigment particles.

When cool, the diluted composition contains toner particles which are somewhat swelled and plasticized by the carrier liquid. The toner particles have a fiberous structure which reduces compressibility during contact electrostatic transfer and also improves transfer efficiency. These toners have demonstrated the capability of producing high quality color images in certain contact electrostatic transfer processes. However, recently a large number of patents have been issued (mostly to DuPont) which describe specific charge directors and/or charge adjuvants intended to improve these toners. The data in these patents indicate that the imaging properties of these toners are very dependent upon the pigments used. The color blind property has not been demonstrated and charge stability may be a problem. Also, these polyethylene-based toners tend to gel heavily at a high solids content making them unsuitable for use in a high solids replenishment system.

Other U.S. patents which are directed to liquid electrostatic toners, which might be relevant to the present invention, include the following:

Kosel (U.S. Pat. No. 3,900,412) teaches a liquid toner having dispersion phase of pigments in a liquid hydrocarbon system. The toner contains an amphipathic polymeric molecules composed of two moieties. One moiety being a dispersant and a fixative to bond the molecules to a substrate, while the second moiety has a very small particle size. The first part of the amphipathic polymeric being dissolved in the liquid hydrocarbon system, while the second part being in the pigment phase.

Landa et al. (U.S. Pat. No. 4,378,422) discloses a gap electrostatic imaging process which uses a developing liquid comprising an insulating carrier liquid and toner particles.

Riesenfeld et al. (U.S. Pat. No. 4,732,831) teaches a liquid electrostatic master which contains a combination of specific polymeric binder, an ethylenically unsaturated photopolymerizable monomer, a specific chain transfer agents, and specific stabilizer.

Mitchell (U.S. Pat. No. 4,734,352) teaches liquid electrostatic developer containing (a) a nonpolar liquid carrier; (b) thermoplastic resin particles having an average particle size of less than 10 microns; (c) an ionic or zwitterionic compound soluble in said nonpolar liquid carrier; and (d) a polyhydroxy compound.

Bujese et al. (U.S. Pat. No. 4,786,576) teaches a liquid electrostatic toner containing an alcohol insoluble maleic modified rosin ester and an ethylene-ethylacrylate copolymer.

Croucher et al. (U.S. Pat. No. 4,789,616) teaches a liquid electrostatic toner containing a dyed polymer and amphipathic stabilizer.

El-Sayed et al. (U.S. Pat. No. 4,798,778) teaches a positive-working liquid electrostatic developer containing (a) nonpolar liquid carrier; (b) thermoplastic resin which is an ethylene homopolymer having a carboxylic acid substituent or a copolymer of ethylene and another monomer having a carboxylic acid substituent; and (c)

ionic or zwitterionic compound which is soluble in said nonpolar liquid carrier.

Tsubuko et al. (U.S. Pat. No. 4,855,207) teaches wet-type electrostatic developers containing colorant particles coated with an olefin resin having a melt index of 25–700 g per 10 minutes, measured under a load of 2,160±10 g. at 190°±0.4° C.

Elmasry et al. (U.S. Pat. No. 4,925,766 and 4,978,598) teaches liquid electrophotographic toners containing chelating copolymer particles comprised of a thermoplastic resinous core with a Tg below room temperature, which is chemically anchored to an amphipathic copolymer steric stabilizer which is soluble in the liquid carrier solvent and has covalently attached thereto moieties of a coordinating compound and at least one metal soap compound.

Elmasry et al. (U.S. Pat. No. 4,946,753) teaches liquid electrophotographic toners wherein the toner particles are dispersed in a nonpolar carrier liquid and wherein (a) the ratio of conductivities of the carrier liquid to the liquid toner is less than 0.6 and (b) the zeta potential of said toner particles is between +60 mV and +200 mV.

Chan et al. (U.S. Pat. No. 4,971,883) teaches a negative-working electrostatic liquid developer containing (a) nonpolar liquid carrier; (b) particulate reaction product of a polymeric resin having free carboxyl groups and a specific metal alkoxide; and (c) ionic or zwitterionic charge director compound soluble in the nonpolar liquid carrier.

Jongewaard et al. (U.S. Pat. No. 4,988,602) teaches liquid electrophotographic toners containing chelating copolymer particles dispersed in a nonpolar carrier liquid, said chelating copolymer particles comprising (a) a thermoplastic resin core having a Tg of 25° C. or less and is insoluble or substantially insoluble in said carrier liquid and is chemically anchored to an amphipathic copolymer steric stabilizer containing covalently attached groups of a coordinating compound which in turn are capable of forming covalent links with organic-metallic charge directing compounds and (b) a thermoplastic ester resin that functions as a charge enhancing component for the toner. The preferred thermoplastic resins are those derived from hydrogenated rosin having an acid number between 1 and 200, a softening point in the range of 70° C. to 110° C. and being soluble in aliphatic hydrocarbon solvents.

Japanese Patent No. 60-76775 which issued on May 1, 1985 and is assigned to Ricoh Co. Ltd., teaches a liquid developer for providing electrostatic latent images. The developer contains toner particles and additives being dispersed into a petroleum aliphatic hydrocarbon. Said additives include: (a) glycerin or its higher fatty acid mono-ester, (b) diglycerin or its higher fatty acid mono-ester, (c) methyl polyoxyethylene derivative alkyl ether or a condensation product of this compound and polyoxyethylene alkyl ether, (d) diethanol amide of higher fatty acid, or (e) di- or tri-ester of trimellitic acid.

BRIEF SUMMARY OF THE INVENTION

Accordingly, the present invention is directed to a liquid colored toner composition comprising:

(a) a colored predispersion comprising a homogeneous mixture of at least one nonpolymeric resin material, at least one alkoxylated alcohol, and at least one colorant material;
  (1) said nonpolymeric resin material which is characterized by:
    (aa) being insoluble and nonswellable in the liquid carrier;
    (bb) having a melting point between 60° to 180° C.; and
    (cc) having an acid number higher than about 100;
  (2) said alkoxylated alcohol characterized by:
    (aa) being soluble in said nonpolymeric resin;
    (bb) being insoluble in the liquid carrier; and
    (cc) having a melting point from about 40° C. to about 120° C.; and
  (3) said colorant material having an average primary particle size of less than about 0.5 microns;

and wherein said colored predispersion contains about 50% to about 98.5% by weight nonpolymeric resin; about 1% to 20% by weight alkoxylated alcohol; and 0.5% to 30% by weight colorant material; and (b) an aliphatic hydrocarbon liquid carrier having a conductivity of $10^{-9}$ MHOS/cm or less, a dielectric constant of 3 or less, and a flash point of at least about 100° F.;

wherein said toner containing about 0.1% to about 10% by weight colored predispersion and about 99.9% to about 90% by weight of said liquid carrier and said colored predispersion particles having about 0.5–10 micron average particle size and being insoluble and nonswellable in said liquid carrier.

DETAILED DESCRIPTION

The colored predispersion of the toners of the present invention are comprised of three critical ingredients, namely, (A) a nonpolymeric resin; (B) an alkoxylated alcohol; and (C) a colorant agent.

As stated above, the nonpolymeric resin used in the liquid toner of the present invention must possess a specific combination of insolubility (and nonswellability), melting point and acid number characteristics. First, the nonpolymeric resin should be insoluble and nonswellable in the carrier liquid because during the colored predispersion step, the nonpolymeric resin encapsulates the colorant agents thus greatly reducing the charge properties associated with such agents. Thus, the majority of the colorant agent is never exposed directly to the carrier liquid. It is locked within or covered with the nonpolymeric resin which is insoluble and nonswellable in the liquid carrier. "Insoluble in the liquid carrier", as used herein for the nonpolymeric resin, means that less than 1%, preferably less than 0.5% by weight, of the nonpolymeric resin will dissolve in the liquid carrier.

"Nonswellable in the liquid carrier", as used herein for the nonpolymeric resin, means that nonpolymeric resin will not increase in weight more than about 25% by absorption after contacting with the liquid carrier at room temperature followed by removing all free liquid carrier from the nonpolymeric resin.

As stated above, the melting point of the nonpolymeric resin should be between about 60° and 180° C. Preferably, the melting point should be between about 70° and 150° C. The melting point is determined by the ring and ball method.

The acid number should be greater than 100. Acid number means the amount of KOH in mg needed to neutralize 1 gram of resin.

Preferably, the nonpolymeric resin should possess other properties. It should preferably have a Gardner color index of 11 or less. It should preferably be friable enough at room temperature to easily grind to a small particle size using conventional ball milling equipment, for example, an S-1 type attritor. It should preferably have excellent pigment dispersing properties even in the absence of a liquid such as the liquid carrier. They should preferably be easy to use in conventional compounding equipment, for example, a compounding twin-screw extruder. Preferably, the nonpolymeric resin is completely soluble (i.e., forms a clear, nonhazy solution containing no visible precipitates) in ethanol or diethylene glycol at a 1 to 50 wt. % solids loading. Preferably, the nonpolymeric resin is not soluble in water or in mineral spirits (i.e., a mixture of aliphatic, aromatic, or naphthenatic hydrocarbon liquids having a Kauri-Butanol value of 30 to 50) at a 1 to 50 wt. % solids loading.

The most suitable materials for the nonpolymeric resin (A) are maleic modified rosins having acid numbers of 100 or greater. These are also sometimes called "rosin modified maleic acid resins". These include rosins modified with maleic anhydride, maleic and/or fumaric acid, or mixtures thereof. These rosins are chemically modified forms of natural wood rosin, gum rosin, or tall oil rosin. Natural rosins consist of approximately 90% resin acids which are mostly abietic acid or its related isomers and about 10% neutral resins with most structurally similar to abietic acid. Abietic acid contains both a reactive monocarboxylic acid functionality and, also a reactive diene structure. In the maleic modified rosins suitable for this invention both functionalities may be reacted as follows:

1. The diene structure is reacted with maleic anhydride, maleic acid, or fumaric acid by Diehls-Alder reaction. Increasing the reacted amount of maleic anhydride or fumaric acid increases the acid number of the rosin. Increasing the acid number in this manner also further increases the melting point, gloss, and hardness properties.

2. Next, some of the acid groups are esterified with a suitable polyalcohol—examples include pentaerithritol, di- and tri-pentaerithritol, mannitol, sorbitol, among others. This esterification also tends to increase the melting point, hardness, and gloss properties.

Examples of acceptable nonpolymeric maleic modified rosins suitable for component (A) include:

| | Manufacturer | Acid No. | M.P. °C. |
|---|---|---|---|
| Unirez 709 | Union Camp | 117 | 115 |
| Unirez 710 | " | 300 | 145 |
| Unirez 757 | " | 115 | 130 |
| Unirez 7019 | " | 250 | 135 |
| Unirez 7020 | " | 110 | 130 |
| Unirez 7024 | " | 235 | 120 |
| Unirez 7055 | " | 193 | 155 |
| Unirez 7057 | " | 123 | 125 |
| Unirez 7080 | " | 133 | 115 |
| Unirez 7083 | " | 235 | 111 |
| Unirez 7089 | " | 110 | 125 |
| Unirez 7092 | " | 188 | 135 |
| Unirez 7093 | " | 215 | 135 |
| Pentalyn 255 | Hercules | 196 | 171 |
| Pentalyn 261 | Hercules | 205 | 171 |
| Pentalyn 269 | " | 200 | 177 |
| Pentalyn 856 | " | 140 | 131 |
| Pentalyn 821 | " | 201 | 150 |

There are many other chemically modified rosin materials cited in the prior art. Many of these rosins are often cited as being carrier liquid insoluble in the patent literature. However, none of these other rosins meet all our criteria for component (A), and most actually swell and/or dissolve into the carrier liquid. Examples of these resins, which are not acceptable for use in component (A), include natural rosin, rosin esters, hydrogenated rosin, hydrogenated rosin esters, dehydrogenated rosins, polymerized rosin esters, phenolic modified rosins and rosin esters, and alkyl modified rosins.

While maleic modified rosins having acid numbers of 100 or greater are the preferred resins for use as component A, it is anticipated that other nonpolymeric resins which meet the criteria outlined previously may also be used.

The second critical component of the colored predispersion of the invention is at least one alkoxylated alcohol (B) which is defined as having properties:

1. Soluble in the nonpolymeric resin. Soluble means that at a temperature above their melting points alkoxylated alcohols will completely dissolve into the nonpolymeric resin.
2. Insoluble in the liquid carrier. The phrase "insoluble in the liquid carrier", as used herein for the alkoxylated alcohol, means that less than 1%, preferably less than 0.1% by weight, of the alkoxylated alcohol will dissolve in the liquid carrier at room temperature (20°-30° C.).
3. A melting point not less than 40° C. and not greater than 120° C.

The alkoxylated alcohols suitable for use in the toner compositions of this invention should be compatible with the nonpolymeric resin and the colorant.

It has been found that the preferred alkoxylated alcohol has a formula as follows:

$$H\left(CH_2-CH_2\right)_n O\left(\underset{\substack{|\\ R}}{CH}-CH_2-O\right)_m H$$

wherein R is either H or methyl; n is integer from about 12-35; and m is an integer from about 2-90. More preferably, R is H; n is about 15-30; and m is about 3-30 and the ratio of n:m is from about 2:8 to about 8:2. Among the most preferred alkoxylated alcohols suitable for the present invention is UNITHOX 750 ethoxylated alcohol available from Petrolite Specialty Polymers Group of Tulsa, Okla. This block copolymer compound has numerical average molecular weight of 1,400; an ethylene oxide content of 50% by weight; a hydroxyl number of 34; a melting point of 105° C.; flash point of 271° C.; and HLB value of 10. UNITHOX 750 has values of n=25 and m=15 (and R=H) as applied to above formula.

An optional component of the colored predispersion of the present invention is a polymeric plasticizer (D) which is defined as having the following properties:

1. Soluble in the nonpolymeric resin. Soluble means that at a temperature above their melting points the polymeric plasticizer will completely dissolve into the nonpolymeric resin.
2. Insoluble in the liquid carrier. The phrase "insoluble in the liquid carrier", as used herein for the polymeric plasticizer, means that less than 1%, preferably less than 0.1% by weight, of the polymeric plasticizer will dissolve in the liquid carrier.
3. A melting point not less than 35° C. and not greater than 70° C.

The plasticizer suitable for use in the toner compositions of this invention should also be compatible with the nonpolymeric resin, the colorant, and the alkoxylated alcohol.

It has been found that the most preferred materials for the polymeric plasticizer are polyethylene glycols with molecular weights ranging from about 1,000 to about 10,000. Other medium to high molecular weight polyols, such as polyethylene oxide and polyethylene glycol methyl ether, may also be used. Specific examples include:

| Compound | M.W. | Melt Temp. (C) | Viscosity (210° F.) CPS |
|---|---|---|---|
| Polyethylene Glycol | 1,000 | 39 | 17.4 |
| " | 1,500 | 45 | 28.0 |
| " | 2,000 | 49 | 56.0 |
| " | 3,400 | 55 | 90.0 |
| " | 8,000 | 62 | 800.0 |
| " | 10,000 | 63 | 870.0 |
| PEG Methyl Ether | 2,000 | 52 | 54.6 |
| " | 5,000 | 59 | 613.0 |
| Polyethylene Oxide | 100,000 | 66 | — |

These compounds meet the criteria for solubility properties, nonpolymeric resin compatibility, and suitable melting temperatures. In addition, these compounds are ideal because they exhibit very sharp melt points, at which temperatures the viscosity drops dramatically. In other words, these compounds become low viscosity solvents when heated only a couple of degrees above their melting temperatures. This property greatly decreases the fusing temperatures of the disclosed toners and, also, is used to ensure that a smooth, even film is formed on the toned image after fusing. This allows for the use of high melting point nonpolymeric resins which do not swell in the liquid carrier. At room temperature, these polymeric plasticizers are hard, wax-like materials which are not tacky. This is unlike most other known plasticizers. This property enables the toner particles of the present invention to be very hard, friable, and nontacky at room temperature. Surprisingly, even though these polymeric plasticizers are solids at room temperature, it has been found that they greatly improve the flexibility and crack resistance of the fused toned images. It is believed that it is the polymeric nature of these plasticizers which gives us this property.

The third critical component of the colored predispersion is one or more colorant agents (C). These are preferably dry organic or inorganic pigments or dry carbon black. Resinated pigments may also be used, provided the resins meet the criteria for component (A) above. Solvent dyes which are soluble in alcohols or glycols and insoluble in aliphatic hydrocarbon solvents may also be used.

Most common organic pigments may be used in the composition of this invention. The pigments are used in amounts of from about 0.5 to about 30%, preferably from about 5 to about 15% by weight solids in the toner. Pigments suitable for use herein include copper phthalocyanine blue (C.I. Pigment Blue 15), Victoria Blue (C.I. Pigment Blue 1 and 2), Alkali Blue (C.I. Pigment Blue 61), diarylide yellow (C.I. Pigment Yellow 12, 13, 14, and 17), Hansa yellow (C.I. Pigment Yellow 1, 2, and 3), Tolyl orange (C.I. Pigment Orange 34), Para Red (C.I. Pigment Red 1), Naphthol Red (C.I. Pigment Red 2, 5, 17, 22, and 23), Red Lake C (C.I. Pigment Red 53), Lithol Rubine (C.I. Pigment Red 57), Rhodamine Red (C.I. Pigment Red 81), Rhodamine Violets (C.I. Pigment Violet 1, 3, and 23), and copper phthalocyanine green (C.I. Pigment Green), among many others. Inorganic pigments may also be used in the toner composition of this invention. These include carbon black (C.I. Pigment Black 6 and 7), chrome yellow (C.I. Pigment Yellow 34), iron oxide (C.I. Pigment Red 100, 101, and 102), and Prussian Blue (C.I. Pigment Blue 27), and the like. Solvent dyes may also be used, provided they are insoluble in the carrier solvent and soluble in the binder resin. These are well-known to those skilled in the art.

The nonpolymeric resin (A), alkoxylated alcohol (B), colorant (C), and the optional polymeric plasticizer (D) are preferably mixed and kneaded together by heating the mixture at or above the melting temperatures of the nonpolymeric resin and plasticizer and compounding the mixture under high sheer and pressure forces. A twin-screw compounding extruder is preferred; however, other kneading equipment known in the art, such as a Banbury, three roll mill, and the like, may also be used. The purpose of this preferred kneading step is to (1) completely dissolve the alkoxylated alcohol (B) and optional polymeric plasticizer (D) into the nonpolymeric resin (A); and (2) completely and homogeneously disperse the colorants (C) into the nonpolymeric resin (A), alkoxylated alcohol (B), and the optional polymeric plasticizer (D). Organic pigments should ideally be broken down to their primary particle sizes after which each pigment particle is completely wetted and coated by the resin, alcohol, and plasticizer mixture. This ensures that maximum color strength and transparency is achieved.

After the resin (A), alcohol (B), colorants (C), and optional plasticizer (D) are fully kneaded and cooled, a small sample is usually checked to ensure that the dispersion is complete. This can be checked by preparing a thin film coating of the blend, for example, by smearing a small piece on a hot microscope slide and viewing the thin film under a optical microscope. Most organic pigments have average primary particle sizes in the 0.05 to 0.5 micron range which is too small to readily see in most optical microscopes. Compounding is complete when the sample has a smooth, even color. Small amounts of large, visible particles are generally acceptable. However, large amounts of visible particles, or a grainy appearance, means that the kneading process is not complete and must be repeated. It is important that the kneading step be done in the absence of any solvent or the color blind property may be lost.

After the kneading step, the blend is usually broken into a coarse powder (about 100 micron particle size) using, for example, a Fitz mill, corn mill, mortar and pestle, or a hammer mill.

The acceptable and preferred ranges of nonpolymeric resin (A), alkoxylated alcohol (B), colorants (C), and optional polymeric plasticizer (D) are as follows:

| | Acceptable | Preferred | Most Preferred |
|---|---|---|---|
| Nonpolymeric Resin (A) | 50–98.5% | 70–90% | 73–84% |
| Alkoxylated Alcohol (B) | 1–20 | 5–15 | 6–12 |
| Colorants (C) | 0.5–30 | 5–15 | 8–12 |
| Polymeric Plasticizer (D) | 0–20 | 5–15 | 6–12 |

The completely kneaded blend of nonpolymeric resin (A), alkoxylated alcohol (B), colorants (C), and optional polymeric plasticizer (D) will hereafter be referred to as colored predispersion.

In addition to the colored predispersion, the toner contains an aliphatic hydrocarbon carrier liquid (E)

having a conductivity of $10^{-9}$ MHOS/cm or less, a dielectric constant of 3 or less, a flash point of 100° F. or greater, and, preferably, a viscosity of 5 cps or less.

The preferred organic solvents are generally mixtures of $C_9$–$C_{11}$ or $C_9$–$C_{12}$ branched aliphatic hydrocarbons. The liquid carrier (E) is, more preferably, branched chain aliphatic hydrocarbons and more particularly ISOPAR G, H, K, L, M, and V. These hydrocarbon liquids are narrow cuts of isoparaffinic hydrocarbon fractions with extremely high levels of purity. For example, the boiling range of ISOPAR G is between 157° and 176° C., ISOPAR H between 176° and 191° C., ISOPAR K between 177° and 197° C., ISOPAR L between 188° and 206° C., ISOPAR M between 207° and 254° C., and ISOPAR V between 254.4° and 329.4° C. ISOPAR L has a midboiling point of approximately 194° C. ISOPAR M has a flash point of 80° C. and an auto-ignition temperature of 338° C. Stringent manufacturing specifications ensure that impurities, such as sulphur, acids, carboxyls, and chlorides, are limited to a few parts per million. They are substantially odorless, possessing only a very mild paraffinic odor. They have excellent odor stability and are all manufactured by the Exxon Corporation. High purity normal paraffinic liquids NORPAR 12, NORPAR 13, and NORPAR 15, also manufactured by Exxon Corporation, may be used. These hydrocarbon liquids have the following flash points and auto-ignition temperatures.

| Liquid | Flash Point (°C.) | Auto-Ignition Temp. (°C.) |
|---|---|---|
| NORPAR 12 | 69 | 204 |
| NORPAR 13 | 93 | 210 |
| NORPAR 15 | 118 | 210 |

All of these liquid carriers have vapor pressures at 25° C. are less than 10 Torr. ISOPAR G has a flash point determined by the tag closed cup method of 40° C. ISOPAR H has a flash point of 53° C. determined by ASTM D 56. ISOPAR L and ISOPAR M have flash points of 61° C. and 80° C., respectively, determined by the same method. While these are the preferred dispersant nonpolar liquids, the essential characteristics of all suitable dispersant nonpolar liquids are the electrical volume resistivity and the dielectric constant. In addition, a feature of these liquid carriers is a low Kauri-Butanol value less than 30, preferably in the vicinity of 27 or 28, determined by ASTM D 1133.

The toner may also optionally contain a graft-type amphipathic copolymer (F). It is often desirable to use a graft-type amphipathic copolymer to aid the dispersion of the toner particles. Preferred amphipathic graft polymers are characterized as having a carrier soluble component and a grafted carrier insoluble component. The grafted insoluble component should preferentially adsorb on the surface of the toner particles. These types of polymers are described by Kosel (U.S. Pat. No. 3,900,412) and Tsubuko (U.S. Pat. No. 3,992,342) among others.

One particularly useful and preferred amphipathic copolymer can be prepared in the manner of Example XI of U.S. Pat. No. 3,900,412 in three steps as follows:

Part A—Copolymerize 3 wt. % glycidyl methacrylate with 97 wt. % lauryl methacrylate in ISOPAR H. The reaction temperature and monomer addition should be adjusted to produce a M.W. of about 40,000. About 0.5% azobisisobutyronitrile can be used as an initiator.

Part B—Esterify about 25% of the oxirane groups from Part A with methacrylic acid to form pendant carbon-carbon double bond graft sites. All of the methacrylic acid should be esterified. Dodecyldimethylamine can be used as the esterification catalyst.

Part C—Polymerize about 8 wt. % of methyl methacrylate in the presence of the Part B to give the resultant graft-type amphipathic copolymer.

In addition to giving superior dispersing properties, this preferred amphipathic copolymer also gives the toner particles strong, negative charges when maleic modified rosins are used as the nonpolymeric resin (A). Since the above polymer is essentially nonionic and is also a very weak base, its conductivity in ISOPAR H is very low (i.e., $<10^{-11}$ MHOS/cm at 1% solids). As such, it is not clear why the above preferred amphipathic copolymer gives the toners strong, negative charges having high mobilities with relatively high conductivities. It is believed that the above preferred amphipathic copolymer provides a local polar environment when absorbed on the toner surface which enables the deprotonation of some toner surface acid groups. In addition, there is evidence that the graft-type amphipathic copolymer solubilizes small fractions of the maleic modified rosin, leading to complex interactions between above preferred amphipathic copolymer, solubilized rosin, and the toner surface.

Another optional ingredient is an ionic or zwitterionic charge director (G) soluble in the carrier liquid.

Many are known in the art. Examples of negative charge directors include lecithin, basic calcium petronate, basic barium petronate, sodium dialkyl sulphosuccinate, and polybutylene succinimide, among many others. Examples of positive charge director agents include aluminum stearate, cobalt octoate, zirconium naphthenate, and chromium alkyl salicylate, among others.

Another optional ingredient is a carrier liquid insoluble charge adjuvant (H).

Charge adjuvants are used to improve the toner charging and mobility. This is especially true when using an ionic or zwitterionic-type charge director. It has been found that particularly useful negative charge adjuvants include carrier liquid insoluble phosphonated or sulfonated compounds, such as phosphoric acid. Examples of these types of charge adjuvants are described by Larson (U.S. Pat. No. 4,681,831) and Gibson (U.S. Pat. No. 4,891,286). Useful positive charge adjuvants include copolymers based upon vinyl pyridine or dimethylaminoethyl methacrylate, among others. Other types of charge adjuvants are known in the art and most may be used with the toners described herein.

Another optional ingredient is a wax (I). Toner redispersion properties can be improved somewhat by incorporating a small amount of wax into the toner during the ball milling step. The use of waxes for improving the toner redispersion properties are well-known in the art. However, it is not desirable to use more than 10 wt. % of wax as compared to the total toner solids or use more than 2 wt. % of wax as compared to the total liquid toner concentrate, otherwise both transparency and the toner concentrate viscosity will suffer. Particularly useful waxes include:

| | Melt Point (°F.) |
|---|---|
| Bayberry | 100–120 |
| Beeswax | 143.6–149 |

-continued

| | Melt Point (°F.) |
|---|---|
| Candelilla | 155-162 |
| Carnauba | 181-187 |
| Ceresine | 128-185 |
| Japan | 115-125 |
| Micro-crystalline | 140-205 |
| Montan | 181-192 |
| Ouricury | 180-184 |
| Oxidized microcrystalline | 180-200 |
| Ozokerite | 145-185 |
| Paraffines | 112-165 |
| Rice Bran | 169-180 |
| Spermaceti | 108-122 |
| Ross Wax 140 | 280-284 |

The colored predispersion; carrier liquid (E); and optional components (F), (G), (H), and (I) are usually blended together and finely ground by use of a suitable ball mill. The preferred ball mill is of the attritor type, for example, an S-1 Attritor available from Union Process Corp. of Akron, Ohio. However, other mills known in the art such as a pebble mill, vibration mill, sand mill, and the like, may also be used. The toner ingredients are normally ball milled at 20 to 50 wt % solids loading in the carrier liquid in order to prepare a high solids liquid toner concentrate. The goal of the ball milling step is to grind the colored predispersion down to the following particle size ranges:

| | Acceptable | Most Preferred |
|---|---|---|
| Colored Predispersion | 0.5 to 10 micron | 1 to 3 micron |

The lower limit of acceptable toner particle size is very dependent upon the average primary particle sizes of the colorant or pigment (C). An object of this invention is to significantly reduce or eliminate pigment interactions upon the toner charging and imaging properties. This is accomplished by encapsulating most, and preferably all, of the pigment surfaces within the toner particles. It is important that the minimum toner particle size be at least two times the average primary pigment particle size and preferably four times, or greater, than the average primary pigment particle size. A toner particle size in the 3 to 5 micron range is generally the upper limit for very high resolution imaging applications, although toner particle sizes up to 10 microns may be acceptable for many less demanding applications.

The acceptable and preferred range of solids contents of the colored predispersion and components (F), (G), (H), and (I) are as follows:

| | Acceptable Range | Preferred Range |
|---|---|---|
| Colored Predispersion | 40-100% | 77-100% |
| Graft Amphipathic Copolymer (F) | 0-20 | 0-10 |
| Charge Director (G) | 0-5 | 0-1 |
| Charge Adjuvant (H) | 0-5 | 0-2 |
| Wax (I) | 0-30 | 0-10 |

After the ball milling step is completed, the toner is preferably diluted to 0.2 to 3 wt. % solids content in the carrier liquid for use in a printer or copier.

Liquid color toner compositions of the present invention have the following properties:

1. Charge properties which are stable over time.
2. Charge properties which are predictable and reproducible.
3. Charge properties which are not influenced by most pigments.
4. Charge properties which are similar for different color toners—in other words, color blind.
5. Toner particles which are totally charged to one polarity, i.e., all particles are positively charged or all are negatively charged.
6. Toner particles suitable for developing known photoreceptors at low, medium, and high development speeds.
7. Toners suitable for use in known contact electrostatic transfer processes, i.e., give good transfer efficiency.
8. Toners suitable for use in gap electrostatic transfer processes such as those described by Bujese (U.S. Pat. No. 4,786,576).
9. Toners capable of imaging at least 5 to 95% half-tone dots using a 150 line screen ruling.
10. Toners capable of imaging at least a 10 micron line resolution.
11. Process color toners capable of imaging at Specifications for Web Offset Printing (S.W.O.P.) image densities.
12. Color toners capable of producing images which have transparencies equal to, or better than, those obtained by offset printing inks.
13. Toners which are free-flowing at more than 40% solids concentration and are suitable for use in a high solids replenishment system.
14. Toners which redisperse easily upon settling.
15. Toners which do not film-form upon settling.
16. Toners capable of fusing below 100° C.
17. Toners capable of excellent adhesion to paper, metal, plastic, or glass surfaces.
18. Toners capable of imaging on conductive fluoropolymer substrates using a gap electrostatic transfer process.
19. Toners capable of transferring completely from a fluoropolymer substrate to a paper, metal, or plastic substrate.

The liquid color toner composition is especially suitable for use in a gap transfer xero printing process, such as that described in U.S. Pat. No. 4,786,576, which is incorporated herein by reference. This patent describes a method of fabricating a toned pattern on an electrically isolated nonabsorbent conductive receiving surface, comprising the steps of:

(a) establishing a charged electrostatic latent image area on an electrostatically imageable surface;

(b) developing the electrostatic latent image area by applying to the electrostatically imageable surface charged toner particles of a predetermined height suspended in a liquid comprised at least partially of a nonpolar insulating solvent to form a first liquid layer with a first liquid surface, the charged toner particles being directed to the latent image area of the electrostatically imageable surface to form a developed latent image;

(c) applying to the conductive receiving surface a liquid comprised at least partially of a nonpolar insulating solvent to form a second liquid layer with a second liquid surface;

(d) establishing an electric field between the electrostatically imageable surface and the conductive receiving surface by connecting a D.C. voltage directly to the conductive receiving surface;

(e) placing the conductive receiving surface adjacent to the electrostatically imageable surface so that a gap is maintained therebetween, and the first liquid surface contacts the second liquid surface to create a liquid transfer medium across the liquid-filled gap, the liquid-filled gap being of a depth greater than the height of the toner particles;

(f) transferring the developed latent image from the electrostatically imageable surface at a point of transfer through the liquid to the conductive receiving surface to form a transferred toner particle image in an imaged area and defined nonimaged area where toner particles are absent;

(g) maintaining the gap during transfer of the developed latent image between the electrostatically imageable surface and the conductive receiving surface at the point of transfer between at least about 1 mil and about 20 mils; and (h) fusing the transferred toner particles image to the conductive receiving surface.

Additionally, said process may include the following steps:

(a) etching the nonimaged areas of the conductive receiving surface to remove the conductive receiving surface from the nonimaged areas of the conductive receiving surface on the conductor laminate; and (b) removing the toner particles from the imaged area.

Furthermore, said process may employ a conductive fluoropolymer receiving surface and the steps of removing the carrier liquid and transferring the toner off of the fluoropolymer receiving surface to a second receiving surface such as paper by heat and pressure means.

COMPARISON and EXAMPLES

The following Examples and Comparisons are given to better illustrate this invention. All parts and percentages are by weight unless explicitly stated otherwise.

EXAMPLES 1-3

Three colored liquid toners were prepared by the two-part procedure set forth below. These three toners differed only in that each contained a different pigment. The three pigments were Mogul L, Irgalite yellow, and Heliogen blue. They produced black, yellow, and cyan color toners, respectively.

In the first part of the preparation of each of these three toners, the pigment, resin and ethoxylated alcohol were mixed together in the following amounts:

| Ingredient | Weight (Grams) |
|---|---|
| (a) Pigment[1] | 900 |
| (b) Nonpolymeric Resin[2] | 4,646 |
| (c) Ethoxylated Alcohol[3] | 454 |

[1]Either Heliogen Blue D7072 available from BASF, Irgalite Yellow LBIW available from Ciba-Geigy, or Mogul L available from Cabot.
[2]Unirez 7089 available from Union Camp.
[3]Unithox 750 available from Petrolite Specialty Polymers.

For each toner, these three components were added into a sealable plastic container and mixed together by shaking for a few minutes. They were then added into the feed hopper of a twin screw compounding-type extruder (Baker-Perkins). The extruder temperature was adjusted to between 70° and 85° C., and the screw speed was adjusted to 150 rpm. A die with two 1/16 inch holes was fitted onto the extruder outlet. The feed hopper was turned on and the feed rate was adjusted to bring the extrusion torque between 2,000 and 4,000 Newton-meters. It took approximately 20 to 30 minutes to extrude each batch.

Each extruded batch was cooled to room temperature and then pulverized using a Corn Mill. Each formed predispersion comprised a homogeneous powder with an average particle size of about 100 microns.

The second part of each toner preparation involved the attrition of the above-noted colored predispersion, a wax, amphipathic copolymer, and liquid carrier in the following amounts:

| Ingredient | Weight (Grams) |
|---|---|
| (d) Part 1 above | 327 |
| (e) Carnauba Wax | 26 |
| (f) Amphipathic Copolymer[4] | 147 |
| (g) Liquid Carrier[5] | 999 |

(4) A polymer made in the manner of Example XI of U.S. Pat. No. 3,900,412 (15% solids in ISOPAR H).
(5) ISOPAR H available from Exxon.

The Part 2 components were added into a Kady Mill high speed disperser equipped with a cooling water jacket. The batches were milled until the largest particles measured <100 microns using a Hegeman Fineness of grind gauge.

Total mill times were approximately 15 minutes, and the batch temperatures were kept below 100° F. For each toner, these components were then weighed into a 2 liter metal container. An S-1 type attritor (Union Process) containing 60 lbs. of 3/16 inch stainless steel balls was turned to its slowest speed, and the components were slowly added. The attritor cooling water was adjusted to 100° F., after which the mill speed was increased to 250 rpm for 5 hours.

After milling, the majority of the particles each Example were in the 1-10 micron range and they were not flocculated. Carrier liquid ISOPAR H (1,001 grams) was added into the batch and mixed together for a few minutes. Each mill concentrate (15% solids) was then removed from the attritor.

A 1% solids premix was prepared for each toner by diluting 167 grams of each concentrate into 2,333 grams of ISOPAR H.

Various conductivities for these three premixes were determined using an Andeen-Hagerling 1 KHZ ultra-precision capacitance bridge with a Balsbaugh Labs cell. Bulk conductivity ($G_b$) is the measurement of the 1% solids premix as used in a copying machine. Continuous phase centrifugal-separated conductivity ($G_c$) is a measure of the ISOPAR H soluble charge carriers which generally are not strongly associated with toner particles (i.e., separable with the toner particles in the absence of an electric field. The $G_c$ values were determined by centrifuging the 1% solid premixes for at least 2 hours at 6,000 rpm and then measuring the conductivity of the supernatants. The percent $G_c$ was calculated as follows:

$$\% \; G_c = \frac{G_c}{G_b} \times 100$$

Continuous phase electrically-separated conductivity ($G_e$) is a measure of the ISOPAR H soluble charge carriers which are not strongly associated (i.e., separable) with the toner particles in the presence of an electric field. These $G_e$ values were determined by plating-out the toner particles using the Balsbaugh Labs cell.

The voltage in the cell was adjusted to 1,000 volts D.C. which was equivalent to an electric field of about one volt per micron. Plating time was 10 minutes after which the supernatant was removed and transferred to a second Balsbaugh Labs cell in which the $G_e$ was measured. The percent $G_e$ was calculated as follows:

$$\% \; G_e = \frac{G_e}{G_b} \times 100$$

These measured and calculated values are set forth in Table I. Based on the data summarized in Table I, the physical properties of the toners of Examples E-1, E-2, and E-3 and the toners of Comparisons C-1, C-2, and C-3 were comparable to each other (i.e., the differences observed in conductivity performance were not due to significant physical property differences).

The image density (ID) of Examples 1-3 toners was measured using MacBeth RD-919 Densitometer. The "fused image density on the paper" is the density of the image on paper after it goes through a normal copy machine cycle having a heat fuser. The "not fused image density on the paper" is the density of the image on the paper after it goes through a normal copy machine cycle having the heat fuser disconnected. The "image densities before and after transfer from the drum" are determined by running a copy machine through a half printing cycle to obtain a drum image which was half transferred onto paper and was half not transferred onto paper. The drum was removed from the copy machine. The toned images on the drum were removed by a standard tape pull. This included both the part transferred ("after transfer") and the part not transferred ("before transfer"). The images on tape pull were measured with a densitometer. The copy machine used was a Savin 5030 and Savin 2100 paper was employed (except Xerox 4024 paper was used for Examples 2 and 3). The results of these measurements are given in Table II.

The image densities as shown in Table II were used to calculate three different transfer efficiencies of each toner. A 100% transfer implies that all of the imaged toner on the drum is transferred onto the paper. Thus, the higher the transfer efficiency of the toner, the better is its performance. The three transfer efficiency values were determined as follows:

$$\text{Method \#1: } TE\,\% = \frac{ID_{TR}}{ID_{TL}}$$

$$\text{Method \#2: } TE\,\% = \frac{ID_{TR}}{ID_{TR} + ID_{UTR}}$$

$$\text{Method \#3: } TE\,\% = \frac{ID_{TL} - ID_{UTR}}{ID_{TL}}$$

where $ID_{TR}$ = Image density on the paper (not fused).

$ID_{TL}$ = Image density before transfer from the drum.

$ID_{UTR}$ = Image density after transfer from the drum.

These calculated transfer efficiencies are given in Table III. The data in Table III show that the toner samples of the present invention have better or substantially equal transfer efficiencies than the comparison toners, regardless of the method of calculation.

It was visibly observed that the toners of the present invention had much better image smoothness than the toners of the Comparisons. This may be because of more constant image density over the entire paper.

TABLE I

CONDUCTANCE LEVELS

| Example/ Comparison | Pigment | $G_b$ Pico S/cm | $G_c$ Pico S/cm | Percent $G_c$ | $G_e$ Pico S/cm | Percent $G_e$ |
|---|---|---|---|---|---|---|
| E-1 | Mogul L | 9.03 | 8.36 | 92.5% | 1.84 | 20.40% |
| C-1 | Mogul L | 8.98 | 8.32 | 92.64 | 1.59 | 17.72 |
| E-2 | Heliogen Blue | 2.38 | 0.578 | 24.27 | 0.350 | 14.97 |
| C-2 | Heliogen Blue | 1.58 | 0.36 | 23.24 | 0.100 | 6.32 |
| E-3 | Irgalite Yellow | 3.52 | 1.57 | 44.69 | 0.456 | 12.94 |
| C-3 | Irgalite Yellow | 2.38 | 1.03 | 43.43 | 0.311 | 13.06 |

TABLE II

IMAGE DENSITY MEASURED BY MacBETH RD-919 (BLACK) AND X-RITE 404 (CYAN AND YELLOW)

| Toner | Trial No. | ID on the Paper: Fused | ID on the Paper: Not Fused | ID After Transfer From the Drum | ID Before Transfer From the Drum |
|---|---|---|---|---|---|
| E-1 | 1 | 0.959 | 0.970 | 0.264 | 1.310 |
| | 2 | 0.938 | 1.006 | 0.332 | 1.270 |
| | 3 | 0.941 | 0.992 | 0.304 | 1.320 |
| E-2 | 1 | 1.05 | 1.06 | 0.690 | 1.430 |
| | 2 | 1.08 | 1.11 | 0.630 | 1.338 |
| | 3 | 1.06 | 1.06 | 0.644 | 1.470 |
| E-3 | 1 | 0.878 | 0.988 | 0.614 | 1.33 |
| | 2 | 0.867 | 1.00 | 0.708 | 1.33 |
| | 3 | 0.896 | 1.068 | 0.682 | 1.302 |
| C-1 | 1 | 0.842 | 0.938 | 0.293 | 1.350 |
| | 2 | 0.852 | 0.918 | 0.315 | 1.340 |
| | 3 | 0.845 | 0.878 | 0.283 | 1.276 |
| C-2 | 1 | 0.611 | 0.576 | 0.570 | 1.280 |
| | 2 | 0.581 | 0.814 | 0.606 | 1.468 |
| | 3 | 0.530 | 0.770 | 0.650 | 1.450 |
| C-3 | 1 | 0.711 | 0.712 | 0.610 | 1.258 |
| | 2 | 0.696 | 0.764 | 0.686 | 1.280 |
| | 3 | 0.733 | 0.828 | 0.650 | 1.260 |

TABLE III

TRANSFER EFFICIENCY MEASUREMENT IN SAVIN AND IMAGE DENSITY BY MacBETH RD-919 (BLACK) AND X-RITE 404 (CYAN AND YELLOW)

| Example | Trial No. | Method #1 | Method #2 | Method #3 |
|---|---|---|---|---|
| E-1 | 1 | 59.51 | 78.61 | 83.19 |
| | 2 | 77.98 | 75.19 | 75.67 |
| | 3 | 66.13 | 76.54 | 78.99 |
| | Avg. | 67.87 | 76.78 | 79.28 |
| E-2 | 1 | 49.58 | 60.57 | 52.10 |
| | 2 | 40.67 | 63.75 | 63.29 |
| | 3 | 43.76 | 62.21 | 61.19 |
| | Avg. | 44.67 | 62.18 | 58.86 |
| E-3 | 1 | 49.00 | 61.67 | 51.49 |
| | 2 | 53.76 | 58.55 | 40.75 |
| | 3 | 53.67 | 61.03 | 48.44 |
| | Avg. | 52.14 | 60.42 | 46.89 |
| C-1 | 1 | 56.78 | 76.20 | 79.24 |
| | 2 | 56.60 | 74.45 | 77.50 |
| | 3 | 47.67 | 75.62 | 81.92 |
| | Avg. | 53.68 | 75.42 | 79.55 |
| C-2 | 1 | 35.08 | 50.26 | 53.10 |
| | 2 | 45.32 | 57.32 | 52.67 |

TABLE III-continued

| TRANSFER EFFICIENCY MEASUREMENT IN SAVIN AND IMAGE DENSITY BY MacBETH RD-919 (BLACK) AND X-RITE 404 (CYAN AND YELLOW) | | | | |
|---|---|---|---|---|
| Example | Trial No. | Method #1 | Method #2 | Method #3 |
| | 3 | 40.31 | 54.22 | 52.67 |
| | Avg. | 40.24 | 53.93 | 52.81 |
| C-3 | 1 | 43.63 | 53.86 | 38.35 |
| | 2 | 46.58 | 52.69 | 35.12 |
| | 3 | 50.24 | 55.79 | 39.68 |
| | Avg. | 46.82 | 54.11 | 37.72 |

COMPARISONS 1-3

Three colored liquid toners were prepared using the ingredients and by the procedure set forth for Examples 1-3 except that polyethylene glycol (m.w.=8,000) was substituted for the ethoxylated alcohol of those Examples. This polyethylene glycol was PEG-8000 available from Union Carbide. These toners of Comparisons 1-3 produced extremely sharp images with 1 mil resolution, greater than 5% to 95% halftone capability with a 150 line screen, excellent image density, and good transfer off the master. No background imaging was noticed. The toner was nonflocculated and redispersed upon setting. Furthermore, each comparison toner could be heat fused into transparent images at temperatures of about 95°-100° C. and possessed good adhesion to substrates. Other properties are given in Tables I, II, and III and the results explained above.

EXAMPLE 4 and COMPARISON 4

To demonstrate toner color blending ability, 1,250 g of the pigment of Example 2 was blended with 1,250 g of the pigment of Example 3 to produce a green shade toner blend. Each toner and the blend were in a diluted (1% solids) working bath premix form. The blended toner was next added to a Savin 5030 liquid toner copier and 1,400 copies of an 8% coverage test pattern were made with no replenishment of the toner bath. This depleted about 50% of the toner solids in the premix. The depletion caused a continuous drop in image densities throughout the run making it very difficult to colorimetrically compare the first print with a "depleted toner" print and relate this to hue differences. To get around this, the toner bath had to be monitored off-line. Specifically, at 200 copy intervals, the toner was transferred into a plating cell normally used for Q/M testing. Paper was taped over the anode and toner was plated directly onto the paper. The toned paper was next dried and fused with a heat gun. To give constant image densities, plating time was increased according to bath depletion. The toner bath absorbance (OD) was also monitored at 200 copy intervals at 620 nm and 0.03 dilution in ISOPAR H. Before the print test, a plot of blended toner bath absorbance vs. plating time was made at an approximately constant 1.20 image density.

A comparison experiment was then carried out exactly as described above, except for the toner used, i.e., using a blend of C-2 and C-3 instead of a blend of E-2 and E-3.

After the print tests, each plated color "swatch" was measured in CIE L*a*b* color space using a MacBeth 2020PL color-eye. To monitor only the hue differences, L (lightness) values were kept within ±0.1 for each data point. The total color difference (dE) was recorded for each data point as compared with the start. Total color difference is defined as:

$$dE = \sqrt{(\Delta L^*)^2 + (\Delta a^*)^2 + (\Delta b^*)^2}$$

The results of Example 4 testing are shown in Table IV. The results of Comparison testing are shown in Table V. That data shows that the difference in dE for the blended toner of the present invention is less than the dE for the blended toner of the Comparison. This smaller dE difference indicates that the blended toner of the present invention is more "color blind" than the blended Comparison toner.

TABLE IV

| Count | O.D. | L* | a* | b* | dE |
|---|---|---|---|---|---|
| Start | 0.79 | 51.46 | −47.10 | 22.06 | — |
| 200 | 0.70 | 51.44 | −45.10 | 17.87 | 4.64 |
| 400 | 0.64 | 51.44 | −49.01 | 18.10 | 4.40 |
| 600 | 0.59 | 51.44 | −50.07 | 17.42 | 5.51 |
| 800 | 0.54 | 51.45 | −49.14 | 16.23 | 6.18 |
| 1000 | 0.48 | 51.47 | −50.59 | 16.24 | 6.79 |
| 1200 | 0.42 | 51.45 | −51.49 | 15.59 | 7.82 |
| 1400 | 0.39 | 51.44 | −49.01 | 14.29 | 8.00 |

TABLE V

| Count | O.D. | L* | a* | b* | dE |
|---|---|---|---|---|---|
| Start | 0.83 | 51.45 | −46.31 | 21.93 | — |
| 200 | 0.75 | 51.47 | −47.57 | 18.54 | 3.60 |
| 400 | 0.71 | 51.47 | −47.00 | 15.63 | 6.34 |
| 600 | 0.65 | 51.46 | −46.88 | 13.95 | 8.00 |
| 800 | 0.63 | 51.47 | −46.93 | 12.59 | 9.36 |
| 1000 | 0.59 | 51.48 | −46.68 | 11.52 | 10.42 |
| 1200 | 0.55 | 51.43 | −46.51 | 10.10 | 11.83 |
| 1400 | 0.52 | 51.47 | −45.53 | 9.58 | 12.37 |

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirely.

What is claimed is:

1. A liquid toner composition comprising:

(a) a colored predispersion comprising a homogeneous mixture of at least one nonpolymeric resin material, at least one alkoxylated alcohol, and at least one colorant material;

(1) said nonpolymeric resin material characterized by:

(aa) being insoluble and nonswellable in the liquid carrier;

(bb) having a melting point between about 60° to 180° C.; and (cc) having an acid number higher than about 100;

(2) said alkoxylated alcohol characterized by:

(aa) being soluble in said nonpolymeric resin;

(bb) being insoluble in the liquid carrier;

(cc) having a melting point from about 40° C. to about 120° C.; and (3) said colorant material having an average primary particle size of less than about 0.5 microns;

and wherein said colored predispersion contains about 50% to about 98.5% by weight nonpolymeric resin; about 1.0% to about 20% by weight alkoxylated alcohol; and 0.5% to about 30% by weight colorant material; and an aliphatic hydrocarbon carrier liquid having a conductivity of $10^{-9}$ MHOS/$_{cm}$ or less, a dielectric constant of 3 or less, and a flash point of at least about 100° F.;

wherein said toner containing about 0.1% to about 10% by weight colored predispersion and about 99.9% to about 90% by weight of said liquid carrier and said colored predispersion particles having about 0.5–10 micron average particle size and being insoluble and nonswellable in said liquid carrier.

2. The liquid toner of claim 1 wherein said nonpolymeric resin is a maleic modified rosin.

3. The liquid toner of claim 1 wherein said alkoxylated alcohol has a formula:

$$H\text{-}(CH_2-CH_2)_n-O-(\underset{\underset{R}{|}}{CH}-CH_2-O)_m-H$$

wherein R is either H or methyl; n is an integer from about 12–35; and m is an integer from about 2–90.

4. The liquid toner of claim 1 wherein said colorant material is a pigment material.

5. The liquid toner of claim 1 wherein said colored predispersion comprises a homogeneous mixture of a maleic modified rosin, an ethoxylated alcohol having a formula:

$$H\text{-}(CH_2-CH_2)_n-O-(CH_2-CH_2-O)_m-H$$

wherein n is from about 15–30 and m is about 3–30, and the ratio of n:m is from about 2:8 to 8:2, and a pigment material.

6. The liquid toner of claim 1 wherein said maleic modified rosin is about 70% to about 90% by weight of the colored predispersion.

7. The liquid toner of claim 1 wherein said polyethylene glycol having a molecular weight from about 1,000 to about 10,000 is about 5% to about 15% by weight of the colored predispersion.

8. The liquid toner of claim 6 wherein said organic or inorganic pigment material is from about 5% to about 15% by weight of said colored predispersion.

9. The liquid toner of claim 1 wherein said liquid toner additionally contains a graft amphipathic copolymer in an amount from 0% to about 20% by weight of the solids of said liquid toner.

10. The liquid toner of claim 1 wherein said liquid toner additionally contains a ionic or zwitterionic charge director soluble in said liquid carrier in an amount from 0% to about 5% by weight of the solids of said liquid toner.

11. The liquid toner of claim 1 wherein said liquid toner additionally contains a charge adjuvant in the amount from 0% to about 5% by weight of the solids content of said toner.

12. The liquid toner of claim 1 wherein said liquid toner additionally contains a wax in the amount from about 0% to about 30% by weight of the solids content of said toner.

13. The liquid toner of claim 1 wherein said solids content of said liquid toner is from about 0.2% to about 3% by weight.

14. A liquid toner concentrate composition comprising:

(a) a colored predispersion comprising a homogeneous mixture of at least one nonpolymeric resin material, at least one alkoxylated alcohol, and at least one colorant material;

(1) said nonpolymeric resin material characterized by:

(aa) being insoluble and nonswellable in the liquid carrier;

(bb) having a melting point between about 60° to 180° C.; and (cc) having an acid number higher than about 100;

(2) id alkoxylated alcohol characterized by:

(aa) being soluble in said nonpolymeric resin;

(bb) being insoluble in the liquid carrier;

(cc) having a melting point from about 40° C. to about 120° C. and;

(dd) said alkoxylated alcohol has a formula:

$$H\text{-}(CH_2-CH_2)_n-O-(\underset{\underset{R}{|}}{CH}-CH_2-O)_m-H$$

wherein R is either H or methyl; n is an integer from about 12–35; and m is an integer from about 2–90; and (3) said colorant material having an average primary particle size of less than about 0.5 microns;

and wherein said colored predispersion contains about 50% to about 98.5% by weight nonpolymeric resin; about 1.0% to about 20% by weight alkoxylated alcohol; and 0.5% to about 30% by weight colorant material; and (b) an aliphatic hydrocarbon carrier liquid having a conductivity of $10^{-9}$ MHOS/$_{cm}$ or less, a dielectric constant of 3 or less, and a flash point of at least about 100° F.;

wherein said toner concentrate containing about 20% to about 50% by weight solids and about 80% to about 50% by weight of said liquid carrier and said colored predispersion particles having about 0.5–10 micron average particle size and being insoluble and nonswellable in said liquid carrier.

* * * * *